United States Patent [19]

Davis

[11] 3,965,706

[45] June 29, 1976

[54] LOCKING DEVICE FOR LUGGAGE

[75] Inventor: Michael Davis, New Castle, Pa.

[73] Assignee: Airway Industries Inc., West Pittsburgh, Pa.

[22] Filed: Nov. 25, 1974

[21] Appl. No.: 526,596

[52] U.S. Cl. ..... 70/68; 70/74

[51] Int. Cl.[2] ..... E05B 67/38

[58] Field of Search ..... 70/3–5, 70/67, 68, 69, 6–13; 190/41, 48; 150/3–4; 24/205.11 L; 287/53 SS

[56] References Cited

UNITED STATES PATENTS

| | | | |
|---|---|---|---|
| 1,771,429 | 7/1930 | Wisbith | 150/3 |
| 3,319,743 | 5/1967 | Pelevin | 70/68 X |
| 3,597,945 | 8/1971 | Feinberg | 70/74 |

FOREIGN PATENTS OR APPLICATIONS

| | | | |
|---|---|---|---|
| 188,670 | 4/1956 | Austria | 70/68 |
| 1,173,315 | 12/1969 | United Kingdom | 24/205.11 L |

*Primary Examiner*—Robert L. Wolfe
*Attorney, Agent, or Firm*—Buell, Blenko, and Ziesenheim

[57] ABSTRACT

The specification discloses a locking device for luggage, especially luggage having hinged parts adapted to be joined along the edges by a separable fastener having a pair of slider elements which meet to close the fastener and which have pull tabs secured together to hold the fastener in closed position. The locking device comprises an upstanding pin or stud, displaced laterally of the line of the separable fastener, to which the slider pull tabs are anchored, a locking flap anchored to one part of the luggage case so as to overlie the stud to which the slider tabs are anchored and having a latch which engages in a lock secured to the other part of the luggage case. The flap has a hole through which the anchoring stud extends in the locked position of the flap. The anchoring stud is secured to a base plate and the lock is fastened to the luggage case wall in a fixed relation to the base plate.

3 Claims, 3 Drawing Figures

LOCKING DEVICE FOR LUGGAGE

This invention relates to locking devices for luggage, especially to locking devices which perform a dual locking function in locking the hinged parts of the luggage together as well as locking the tabs of slide fastener elements in closed position.

Various arrangements are known for securing the pull tab of a slide fastener element in closed position or for securing a plurality of slide fastener pull tabs together in closed position. U.S. Pat. Nos. 1,557,382, 2,223,347, and 2,398,947 show slide fastener locking arrangements which are typical of this type of locking arrangement.

When used for luggage, such slide fastener locking arrangements are objectionable partly by reason of appearance and partly by reason of exposure to weather and lack of security due to ease of access to the pull tabs.

A more recent improvement in this field, shown in U.S. Pat. No. 3,597,945, provides a hinged latch plate on one of two connected parts of luggage, which plate has a portion that overlies a locking stud, for the two pull tabs of a slide fastener joining the luggage parts, in the locked position of the latch plate. A combination lock accessible through an opening in the latch plate is provided for releasing the latch and enabling access to the slide fastener tabs.

It is an object of this invention to provide a slide fastener locking arrangement for luggage cases which is simpler in construction than that of the U.S. Pat. No. 3,597,945 and which at the same time locks the parts of the luggage case together independently of the slide fastener.

To attain the above object I provide a flexible latch flap on one part of a luggage case which latches in a lock on the other luggage part, which latch flap overlies a locking stud for the tabs of a slide fastener joining the two luggage parts. Moreover, I provide the latch flap with a hole into which the locking stud extends in the latched position of the flap, thereby insuring against dislodgement of the slide fastener tabs from the stud. In addition, I provide a base member underlying the lock and having holes through which extend means for attaching the lock securely to the wall of the luggage, in fixed relation to the base member to which the locking stud is fixed.

A preferred embodiment of the invention including the above features and other details will be more fully described hereinafter in connection with the accompanying drawings, wherein.

Figure 1:
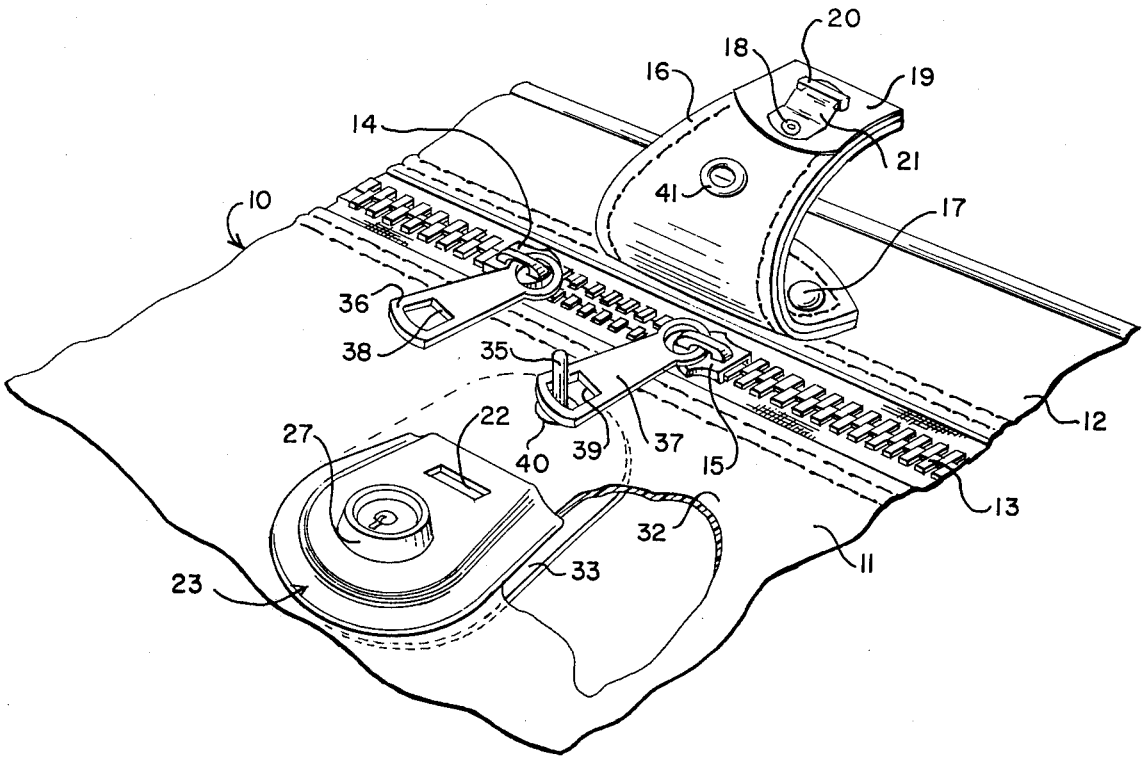
FIG. 1 is a fragmental perspective view, showing the essentials of my novel locking arrangement.

Referring to the drawings, there is shown fragmentally a luggage case 10, having two parts 11 and 12 which are joined along mating edges by a separable fastener 13. Separable fastener 13 comprises two sliders 14 and 15 which approach each other from opposite directions and which meet in abutting relation in the completely closed position of the fastener.

According to my invention, I provide a so-called latch flap 16, secured at one end to the wall of luggage part 12 as by several rivets 17.

The rivets 17 serve to attach the flap 16 to the wall of the luggage case part 12 on a line closely adjacent to the separable fastener 13 for a purpose hereinafter made apparent. Latch flap 16 is preferably made of flexible vinyl sheet material corresponding in substance and color to that of the covering material of the luggage case 10. A laminated or multiple sheet construction of the flap 16 may be provided, stitched adjacent the edges as shown, to insure suitable strength. At its free end flap 16 has secured thereto as by a rivet 18, an end plate 19 of U-shaped cross-section, so as to overlie both faces of the flap. The underside of the end plate has a latching loop 20 formed on or attached thereto. A leaf spring element 21 secured by rivet 18 extends into the loop 20 and is biased to assist in separation of the latch loop 20 from an opening 22 of a lock 23 presently to be described.

Figure 3:
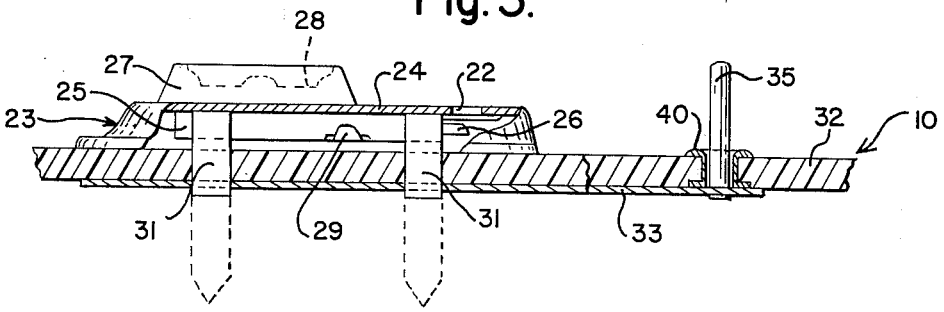
FIG. 3 is a fragmental sectional view, on a somewhat enlarged scale, showing the manner in which the lock base plate and locking stud are attached to the wall of the luggage case.

As will be more readily seen in FIG. 3, lock 23 comprises a flat outer metallic shell 24 of generally horseshoe shape. Within the shell is secured a flat box-shaped lock mechanism 25 having a latch element 26, underlying the rectangular opening 22 in the shell 24 and with which the latch loop 20 cooperates.

On the upper face of shell 24 is a frusto-conical projection 27 having a circular recess 28. Formed in the recess is a suitable slot and opening (not shown) for receiving a key to operate the lock mechanism 25. Projection 27 has a number of tabs 29, one of which is shown, which project through suitable slits in the shell 24 and which engage the lock mechanism 25 to hold it inside the shell 24.

Lock mechanism 25 has a plurality of fingers 31, two of which are shown, which extend through slits in the covering 32 of vinyl material forming part of the wall of the luggage case, and through corresponding holes in a base plate 33 underlying the shell 24 of lock 23. When fingers 31 are bent at a right angle from the extended position thereof, shown in broken lines, they serve to attach the lock 23 and base plate 33 tightly together on opposite sides of the vinyl covering 32. In actual fact, the wall of the luggage case may include a reinforcement or frame of laminated wood which, for simplicity, is omitted from the drawings.

Attached to base plate 33, as by riveting thereto, is a pin or stud 35, to which the tabs 36 and 37 of sliders 14 and 15 may be anchored in the closed position of the sliders. As will be seen particularly in FIG. 1, the tabs 36 and 37 have substantially rectangular openings 38 and 39 therein, by which the tabs may be slipped over the locking stud 35. A tubular metallic eye 40 is preferably provided around the stud 35, partly for appearance and partly to assist in manual pickup of the tabs.

Figure 2:
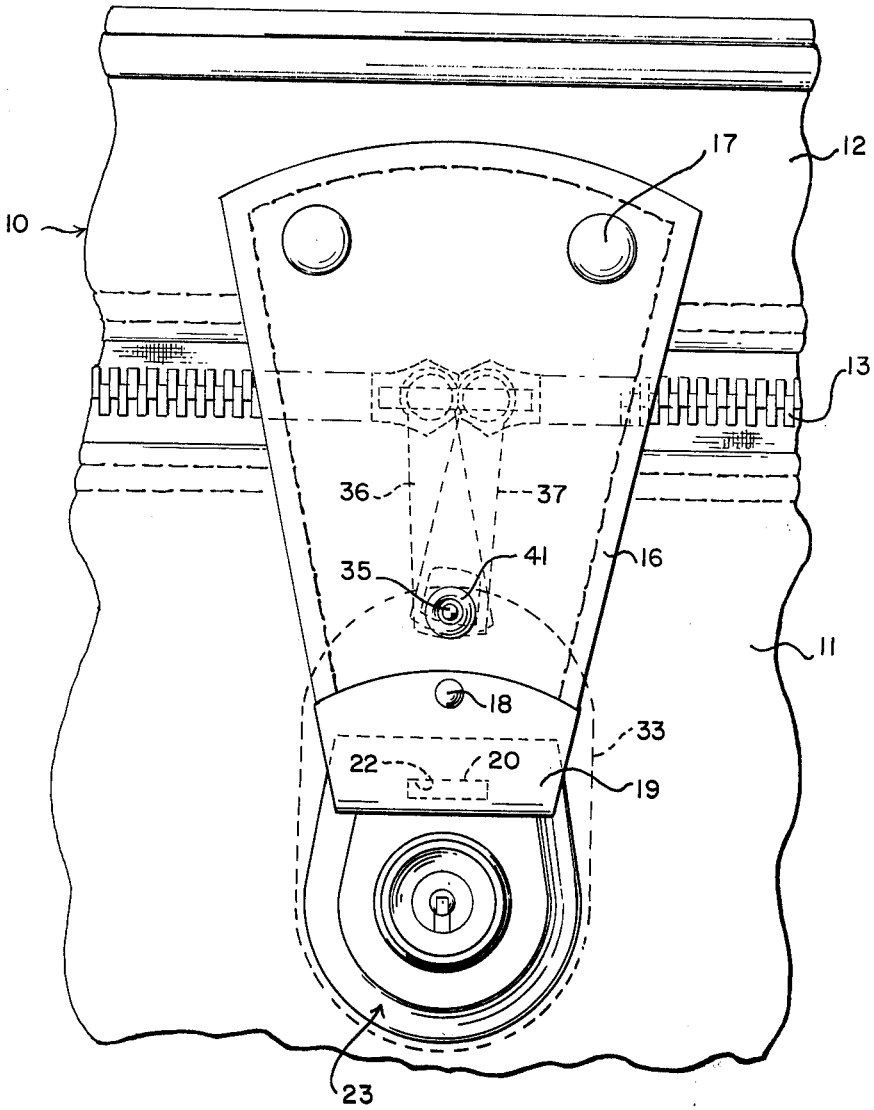
FIG. 2 is a plan view, at substantially full scale, showing the manner in which the latch flap overlies the locking stud for slide fastener tabs in the latched position of the flap.

As will be seen in FIGS. 1 and 2, latch flap 16 is provided with an appropriately located hole in which is fixed, a tubular metallic eye 41. The hole and eye are so located as to register with and slip over stud 35 when the latch flap 16 overlies the tabs 36 and 37 of sliders 14 and 15, in their anchoring position over the stud 35, as shown in broken lines in FIG. 2, and while the latch loop 20 is firmly latched under latch element 26 of locking mechanism 25. It will also be seen that by reason of the attachment of flap 16 by rivets 17 on a line closely adjacent to the line of fastener 13, the flap closely overlies and covers the pull tabs of sliders 14 and 15 at the point of jointure of the sliders.

From the foregoing description it will seem that I have provided a novel locking arrangement for luggage of the type having a separable fastener, wherein a so-called latch flap serves to lock two parts of a luggage case together while at the same time insuring against dislodgement of the tabs of sliders of the separable fastener from a locking stud. It will also be seen that I have provided in simple manner for insuring a fixed relation between the lock for the latching flap and the locking stud for the tabs of the separable fastener sliders.

What I claim and desire to secure by Letters Patent is:

1. A locking device for a luggage case of the type having two parts joined by a separable fastener with a pair of sliders meeting in the closed position of the fastener, wherein the improvement comprises a flap anchored on one part of the luggage case and a lock member on the other part, the flap having thereon a latch which engages in the lock member to lock the parts of the luggage case against separation, a stud fixed in the wall of one of said parts of the luggage case laterally of the line of said separable fastener, to which the pull tabs of said sliders are adapted to be anchored to lock the separable fastener in closed position, said flap overlying said stud and having therein a hole which registers with said stud and through which the stud extends in the locked position of said flap thereby to prevent access to the pull tabs of the sliders while they are anchored to the said stud in the closed position of the fastener.

2. A locking device for a luggage case according to claim 1, wherein a base plate underlies said lock member on the opposite side of the luggage case wall, and wherein securing means that extend through the wall of the luggage case separably anchors the lock member and base plate in fixed relation, said stud being fixed to said base plate and projecting through a hole in the wall of the luggage part to the outside thereof for engagement by the hole in said flap.

3. A locking device for a luggage case according to claim 1, wherein said flap comprises a flexible sheet member attached to said one part on a line closely adjacent to and paralleling said slide fastener, said flap being of such length that in the locked position thereof it tautly overlies the pull tabs of the sliders anchored on said stud.

* * * * *